United States Patent [19]

Fukuda et al.

[11] Patent Number: 4,736,943

[45] Date of Patent: Apr. 12, 1988

[54] WINDUP SPRING USING TOY

[75] Inventors: Satori Fukuda, Sakura; Takashi Matsuda, Tokyo, both of Japan

[73] Assignee: Takara Co., Ltd., Tokyo, Japan

[21] Appl. No.: 920,305

[22] Filed: Oct. 16, 1986

[30] Foreign Application Priority Data

Apr. 30, 1986 [JP] Japan ..... 61-100290
Jul. 16, 1986 [JP] Japan ..... 61-166890

[51] Int. Cl.[4] ..... A63J 23/00; A63H 13/16; A63H 11/00

[52] U.S. Cl. ..... 272/27 R; 446/310; 446/464

[58] Field of Search ..... 272/27 N, 27 R; 446/310, 309, 308, 75, 268, 320, 354, 353, 352, 464, 457, 431, 491, 4, 69

[56] References Cited

U.S. PATENT DOCUMENTS 2,809,834 10/1957 Frampton ..... 446/310 X
3,586,320 6/1971 Mace ..... 272/27 N
4,464,860 8/1984 Onodera ..... 446/491

*Primary Examiner*—Mickey Yu
*Attorney, Agent, or Firm*—Price, Gess & Ubell

[57] ABSTRACT

A windup spring using toy having a divisible container of a single form in its undivided state and including a winder, and a windup spring drive toy to be contained within the container, having a windup spring drive unit therein, which is wound up by the winder of the container when the windup spring drive toy is contained within the container. The windup spring using toy further includes provisions for holding the windup spring drive toy onto the container when the windup spring drive toy is contained within the container, and provisions for releasing the holding of the windup spring drive toy in the container by the output energy of the windup spring drive unit, whereby, on putting the windup spring using toy on a floor after winding up the windup spring, the container divides into two and the windup spring drive toy suddenly appears and starts to run on the floor.

14 Claims, 14 Drawing Sheets

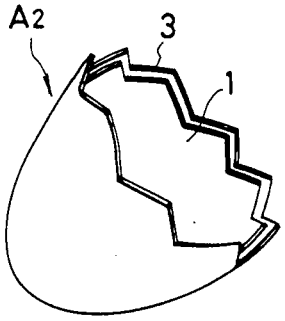
FIG. 2
FIG. 30
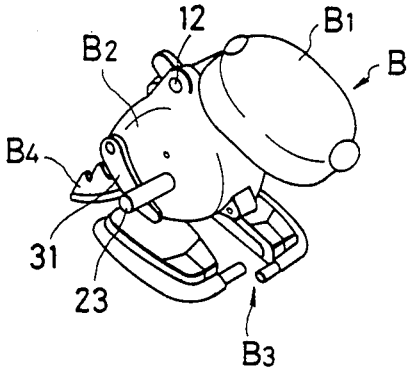
FIG. 31
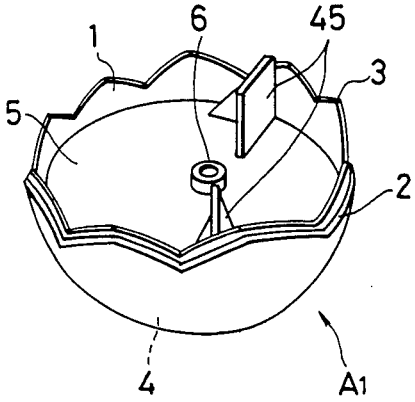

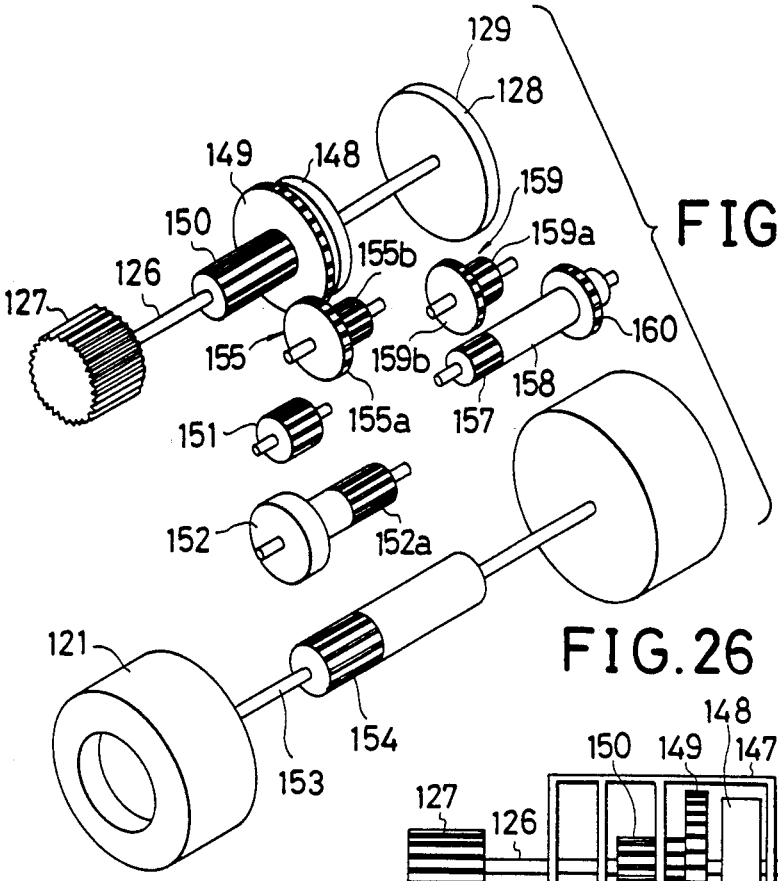
FIG. 27
FIG. 26
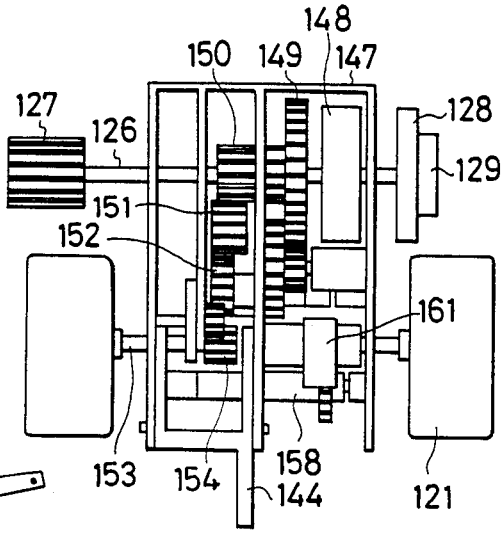
FIG. 29
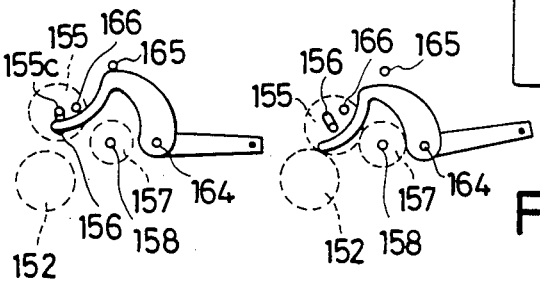
FIG. 28
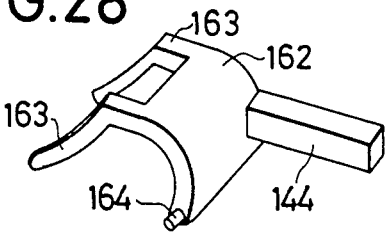

WINDUP SPRING USING TOY

BACKGROUND OF THE INVENTION

The present invention relates to a windup spring using toy and, more particularly, to a combination of a windup spring drive toy and a divisible container therefor having a single form, in which a windup spring is wound up from the outside of the container when the windup spring drive toy is contained within the container, and then the container is so divided quickly or after a certain period of time by virtue of the output energy of the windup spring so that the windup spring drive toy suddenly appears and starts to run on the floor by means of the windup spring.

So far, such an interesting combination toy has never been developed.

SUMMARY OF THE INVENTION

Accordingly, it is an object of the present invention to provide a windup spring using toy, of which a container having a single form is divided quickly or after a certain period by virtue of the output energy of a windup spring wound up from the outside of the container, and then a windup spring drive toy contained within the container suddenly appears and starts to run on the floor by means of the windup spring, which is extraordinary, unexpected and very interesting.

In accordance with one aspect of the invention, there is provided a windup spring using toy comprising, in combination, a divisible container having a single form in its undivided state and including a windup means, and a windup spring drive toy to be contained within the container, having a windup spring drive unit therein, which is wound up by the windup means of the container when the windup spring drive toy is contained within the container, the windup spring using toy further including means for holding the windup spring drive toy onto the container when the windup spring drive toy is contained within the container, and means for releasing the holding of the windup spring drive toy in the container by the output energy of the windup spring drive unit.

Other and further objects, features and advantages of the invention will appear more fully from the following description taken in connection with the preferred embodiments thereof with reference to the accompanying drawings, in which:

BRIEF DESCRIPTION OF THE DRAWINGS

FIG. 2 is an exploded perspective view of one portion of the container shown in FIG. 1;

FIG. 26 is a top plan view of a windup spring drive unit for the windup spring drive toy, excluding an upper part of its case;

FIG. 27 is an exploded perspective view of a combination of an input shaft and a set of gear wheels of the windup spring drive unit of FIG. 26;

FIG. 28 is a perspective view of a speed change lever of the windup spring drive unit of FIG. 26; and FIG. 29 is a schematic view for explaining a speed change by using the lever of FIG. 28;

FIG. 30 is a perspective view of the windup spring drive toy shown in FIG. 1;

FIG. 31 is a perspective view of one portion of the container shown in FIG. 1.

DESCRIPTION OF THE PREFERRED EMBODIMENTS

Figure 1:
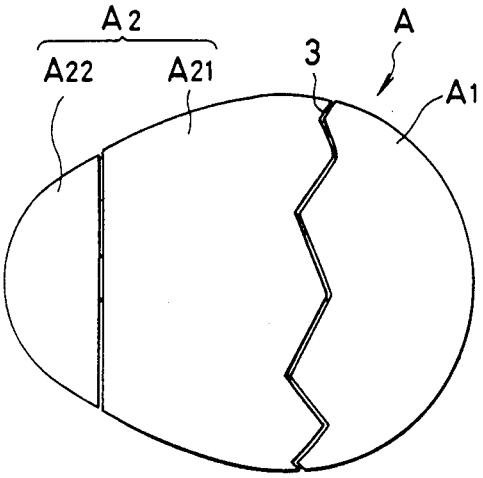
FIG. 1 is a top view of a windup spring using toy, in which a windup spring drive toy is contained within a container, according to the present invention.
Figure 4:
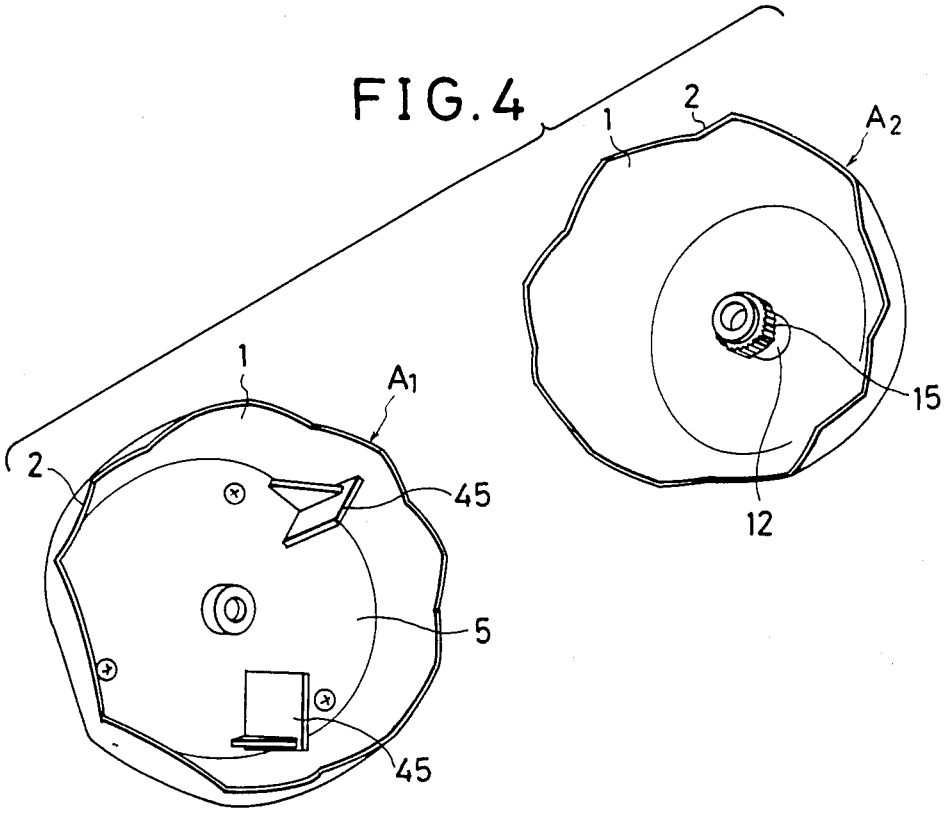
FIG. 4 is an exploded perspective view of the container of FIG. 1.

Referring now to the drawings, wherein like reference numerals designate similar or corresponding components throughout the different figures, there is shown in FIGS. 1–10 the first embodiment of a windup spring using toy according to the present invention.

In FIGS. 1–4, 30 and 31 there is shown a container A having an eggshell form and a windup spring drive toy B having a child dinosaur form.

As shown in FIG. 2, and 31 the container A is divisible and thus comprises two divided members $A_1$ and $A_2$. The divided members $A_1$ and $A_2$ are coupled by placing their open end portions 1 opposite each other and fitting step portions 2 of the open end portions 1 each other, to form a complete eggshell. The open end portions 1 are provided with connection parts 3 which are jagged like a broken eggshell.

Figure 3:
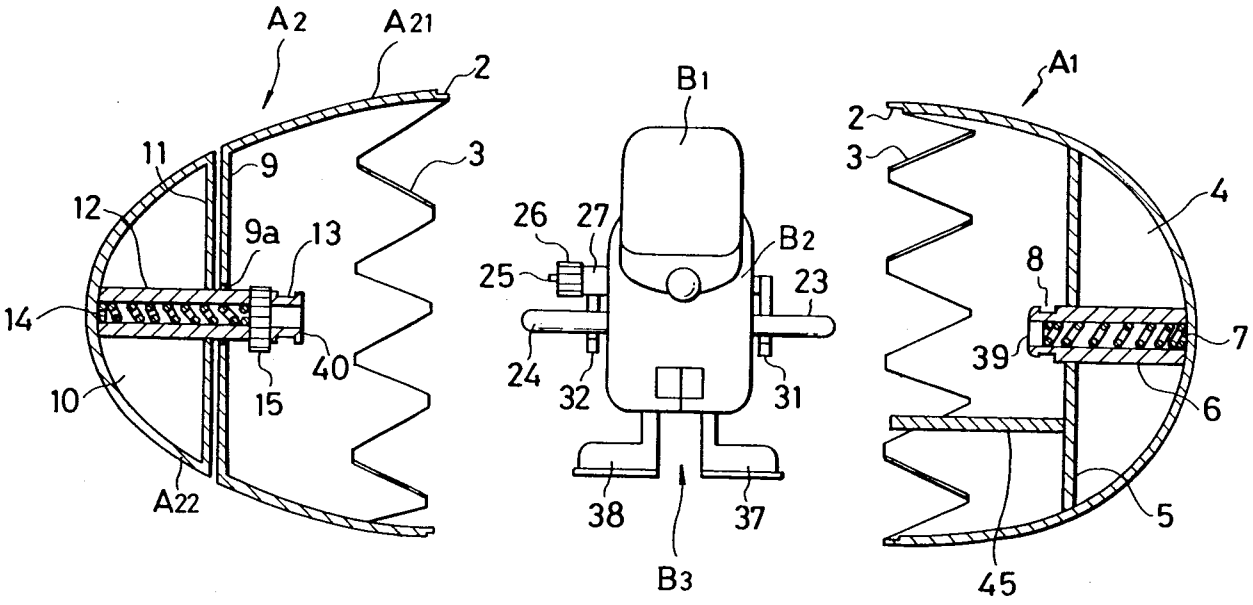
FIG. 3 is an exploded longitudinal cross sectional view of FIG. 1.

As shown in FIG. 3, the divided member $A_1$ is provided with a cylinder 6 which projects from the bottom of its concave portion 4 and extends halfway towards its open end portion and passes through a partition plate 5. In the cylinder 6, a coil spring 7 is fitted, and a groove 8 is formed on an outer periphery of an inner free end of the cylinder 6.

The other divided member $A_2$ comprises a cover part $A_{21}$ having the open end portion 1, for partly covering the windup spring drive toy B, and a windup part $A_{22}$ arranged in the end.

The cover part $A_{21}$ which is obtained by removing the top part of the broken eggshell, possesses a bowl-like form, and is provided with a hole 9a in the center of its cutout bottom 9. The windup part $A_{22}$ having the form of the top part of the eggshell, is provided with a cylinder 12 which projects from the bottom of its concave portion 10 towards the inside and passes through a bottom plate 11 and the hole 9a of the cutout bottom 9 of the cover part $A_{21}$. In the cylinder 12, a coil spring 14 is arranged, and a groove 13 is cut on an outer periphery of an inner free end of the cylinder 12, similar to the cylinder 6 of the divided member $A_1$. A gear wheel 15 having a larger outer diameter than that of the hole 9a of the bottom 9 is so secured to the free end portion of the cylinder 12 close to the bottom 9 that the windup part $A_{22}$ may be rotatably mounted to the cover part $A_{21}$.

The windup spring drive toy B comprises a head part $B_1$, a trunk part $B_2$, a leg part $B_3$ and a tail part $B_4$.

Figure 5:
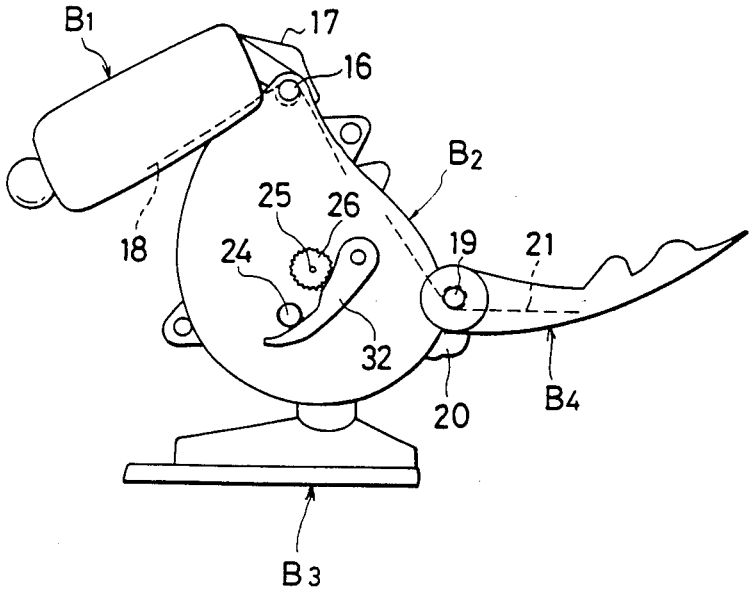
FIG. 5 is a side view of the windup spring drive toy of FIG. 30.

As shown in FIG. 5, the head part $B_1$ is pivotally mounted to the upper portion of the trunk part $B_2$ through a pivot shaft 16, but the pivot motion of the head part $B_1$ is restricted by a stop member 17 attached to the upper portion of the trunk part $B_2$ so that the head part $B_1$ does not pivot upwards. Further, a spring 18 is wound around the shaft 16 and its opposite end portions are secured to the lower side of the head part $B_1$ and the back of the trunk part $B_2$ so as to bias the head part $B_1$ upwards, resulting in that the head part $B_1$ always faces to the front. The tail part $B_4$ is pivotally connected to the rear of the trunk part $B_2$ via a pivot shaft 19 and the pivot motion of the tail part $B_4$ is limited by a stop member 20 mounted to the rear of the trunk part $B_2$ so as to restrict the downward pivot motion. A spring 21 is wound around the shaft 19 and its opposite end portions are mounted to the back of the trunk part $B_2$ and the tail part $B_4$ so as to bias the tail part $B_4$ downwards, with the result that the tail part $B_4$ is always inclined to the rear.

The trunk part $B_2$ includes a windup spring drive unit 22 therein and is provided with right and left support shafts 23 and 24 projecting right and left sideways. The support shafts 23 and 24 are to be inserted into the cylinders 6 and 12 of the container A. An input and output shaft 25 of the drive unit 22 projects from the left side of the trunk part $B_2$, and a gear wheel 26 and a disc plate 27 are mounted on the shaft 25. The gear wheel 26 engages with the gear wheel 15 secured to the cylinder 12 when the shaft 24 is inserted in the cylinder 12. While the gear wheel 26 is secured on the shaft 25, the disc plate 27 is loosely mounted to the shaft 25 to rotate freely around the shaft 25. The disc plate 27 is provided with a cam 28 on its periphery.

Figure 6:
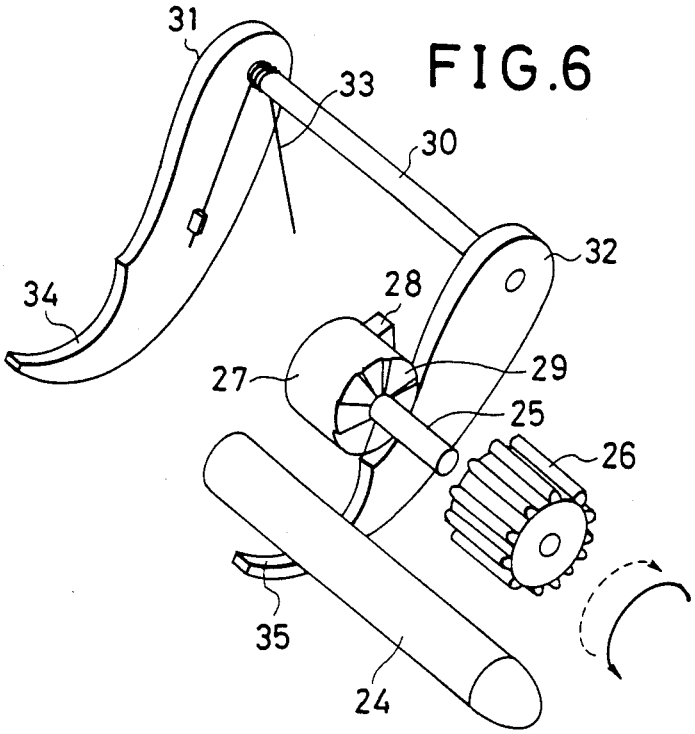
FIG. 6 is an enlarged perspective view of a support shaft, a gear wheel, a disc plate and an engaging member of the windup spring drive toy of FIG. 5.
Figure 7:
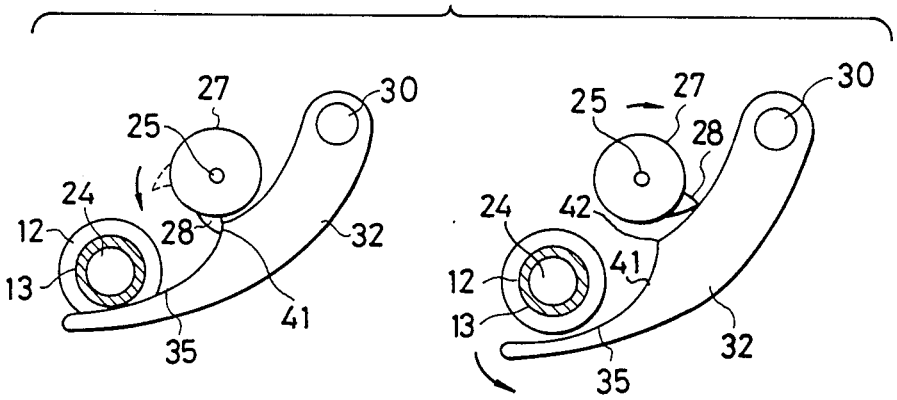
FIG. 7 is an explanatory view for showing functions of the disc plate and the engaging member of FIG. 6.

The gear wheel 26 and the disc plate 27 are coupled by a one-way claw joint 29 formed in their opposite sides, as shown in FIG. 6, so that the disc plate 27 may not engage with the gear wheel 26 and thus be stopped and break when the shaft 25 is rotated along with the gear wheel 26 counterclockwise as indicated by the solid line arrow of FIG. 6, that is, in the direction that a windup spring of the drive unit 22 is wound up, while, on the other hand, the disc plate 27 may engage with the gear wheel 26 and thus always be rotated together with the gear wheel 26 when the shaft 25 is rotated clockwise as indicated by the broken line arrow of FIG. 6. In this case, the windup spring may be wound up through a gear wheel (not shown) fitted on the shaft 25.

A pair of stop levers 31 and 32 are connected with each other by a shaft 30 which is pivotally mounted to the trunk part $B_2$ and passes to the left and right hand sides through the trunk part $B_2$. Hence, the stop levers 31 and 32 are pivotally mounted to the trunk part $B_2$. The stop levers 31 and 32 are biased towards the support shafts 23 and 24 by a spring 33 which is wound around the shaft 30. A free end portion 34 or 35 of each stop lever 31 or 32 is curved close to the support shaft 23 or 24, and the width of each curved free end portion 34 or 35 is determined to be at most the same as that of the groove 8 or 13 of the cylinder 6 or 12.

Figure 8:
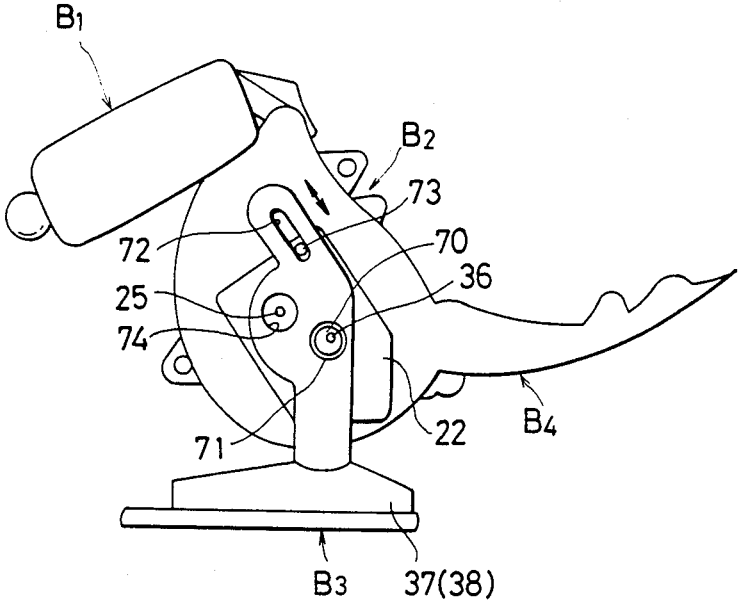
FIG. 8 is a side view, similar to FIG. 5, for explaining the leg of the windup spring drive toy of FIG. 5.
Figure 9:
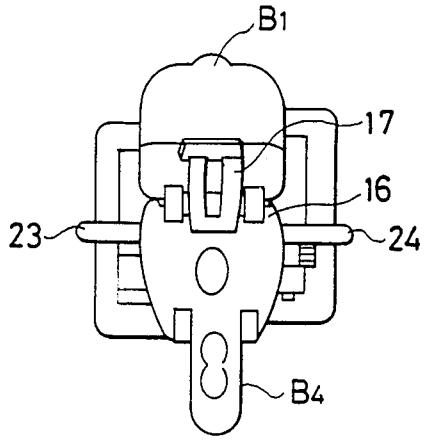
FIG. 9 is a top plan view of the windup spring drive toy of FIG. 5.
Figure 10:
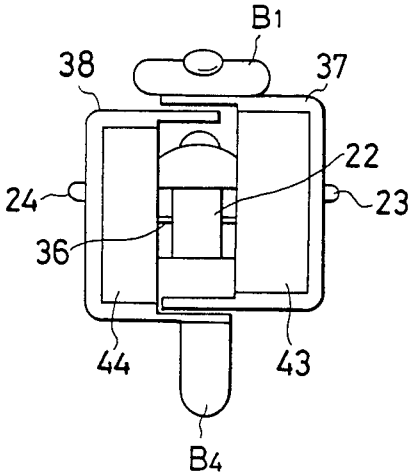
FIG. 10 is a bottom view of the windup spring drive toy of FIG. 5.

As shown in FIG. 8, a pair of leg members 37 and 38 of the leg part $B_3$ are connected to the drive unit 22 via respective eccentric cams 70 secured to another output shaft 36 of the drive unit 22. The leg member 37 or 38 is provided with a circular hole 71 as a cam follower in its middle portion, in which the eccentric cam 70 is loosely fitted. The leg member 37 or 38 is also provided with a guide slot 72 in its upper portion, and a pair of guide pins 73 mounted to the drive unit 22 and projecting sidewards through the guide slots 72. Now, when the eccentric cams 70 are rotated, while the movements of the leg members 37 and 38 are restricted by the guide pins 73, the leg members 37 and 38 are alternately pivoted and moved up and down, and thereafter the windup spring drive toy B continues to walk by the output energy of the drive unit 22. In FIG. 8, a numeral 74 of the leg member 37 or 38 denotes an escape hole for the output shaft 25.

Now, the arrangement of the windup spring drive toy B in the container will be described. First, the head part $B_1$ and the tail part $B_4$ of the drive toy B is folded against the biasing forces of the springs 18 and 21. Then, the left hand side, or the side including the gear wheel 26, of the drive toy B is covered by the cover part $A_{21}$ of the divided member $A_2$, and the right hand side of the drive toy B is covered by the divided member $A_1$. At this time, the support shafts 23 and 24 of the drive toy B are pushed into the cylinders 6 and 12 of the divided members $A_1$ and $A_2$ until the curved free end portions 34 and 35 of the stop levers 31 and 32 are engaged with the grooves 8 and 13 of the cylinders 6 and 12 and the gear wheels 15 and 26 are engaged with each other, while the coil springs 7 and 14 in the cylinders 6 and 12 bias the support shafts 23 and 24 inside. In this case, when the inner ends 39 and 40 of the cylinders 6 and 12 and the curved free end portions 34 and 35 of the stop levers 31 and 32 are tapered, the stranding and the engaging of the curved free end portions 34 and 35 of the stop levers 31 and 32 onto the free ends 39 and 40 and the grooves 8 and 13 of the cylinders 6 and 12 may smoothly and readily be conducted.

By engaging the stop levers 31 and 32 with the grooves 8 and 13 of the cylinders 6 and 12, as described above, the windup spring drive toy B is held onto the container A, thereby obtaining a fixed complete eggshell form of the container, as shown in FIG. 3. In the left hand side of the drive toy B, since the gear wheel 15 of the divided member $A_2$ is engaged with the gear wheel 26 of the drive toy B by inserting the support shaft 24 in the cylinder 12, by rotating the windup part $A_{22}$ by hand, the windup spring of the windup spring drive unit 22 is wound up via the gear wheels 15 and 26. On this occasion, first the disc plate 27 is rotated along with the gear wheel 26 by their friction, but then the further rotation of the disc plate 27 is stopped by butting the cam 28 of the disc plate 27 against a stop surface 41 of the stop lever 32, as shown in FIG. 7*a*. The gear wheel 26 can be rotated to wind up the windup spring of the drive unit 22 regardless of the stopped disc plate 27.

Since the stop surface 41 of the stop lever 32 possesses a radius of curvature smaller than that of its curved free end portion 35 and the upper end portion 42 of the stop surface 41 is overhung, when the cam 28 of the disc plate 27 is contacted with the stop surface 41 of the stop lever 32, an upper oblique stress is given to the stop lever 32, and accordingly the curved free end portions 34 and 35 of the stop levers 31 and 32 are never disengaged from the grooves 8 and 13 of the cylinders 6 and 12.

After stopping the windup operation of the drive unit 22, when the windup spring using toy is put on a floor, the stored energy of the windup spring of the drive unit 22 is released to rotate the shaft 25, as well as the disc plate 27 along with the gear wheel 26, in the reverse direction indicated by the broken line arrow of FIG. 6. When the shaft 25 is rotated approximately one time, the cam 28 of the disc plate 27 pushes down the stop lever 32 against the biasing force of the spring 33 so as to separate the stop lever 32 from the support shaft 24 and thus the curved free end portions 34 and 35 of the stop levers 31 and 32 are disengaged from the grooves 8 and 13 of the cylinders 6 and 12, as shown in FIG. 7*b*. Then the divided members $A_1$ and $A_2$ are sprung apart so as to be divided from each other by the pressure applied to the support shafts 23 and 24 by means of the biasing forces of the coil springs 7 and 14. At the same time, the windup spring drive toy B contained in the divided members $A_1$ and $A_2$ appears, while the folded head part $B_1$ and the tail part $B_4$ are restored to their unfolded condition by the springs 18 and 21, and the windup spring drive toy B starts to run by virtue of the output energy of the windup spring drive unit 22.

In this embodiment, since the windup spring drive toy B is arranged in the container A having an eggshell form, when the container A is put on the floor, it is not known in what position—e.g. upright, upside down, recumbent—it will end up in. To ensure that the windup spring drive toy always stands upright when the container A is divided, the grounding areas of the leg members 37 and 38 are enlarged and the feet of the leg members 37 and 38 are provided with concave parts in their soles for stuffing weights 43 and 44 therein.

Accordingly, when the container A containing the windup spring drive toy B is put on the floor, the container A rolls on the floor and then stops with the windup spring drive toy B always standing upright in the container due to the weights 43 and 44 stuffed in the concave parts of the leg members 37 and 38. Hence, when the container A is divided into two, the windup spring drive toy B always stand upright on its feet on the floor. The divided member $A_1$ may be provided with support plates 45 therein for supporting the trunk part $B_2$ of the windup spring drive toy B in order to elevate its leg part $B_3$ in the air. Thus, when the container A is divided, the tumbling of the windup spring drive toy due to the pulling of the grounding surfaces of the leg members due to the friction between the grounding surfaces and the inside walls of the container A is prevented.

As the above described embodiment, is composed of an eggshell-shaped container and a child dinosaur windup spring drive toy which suddenly emerges from the divided container and starts to run, it is both highly interesting and enjoyable.

Next, there is shown in FIGS. 11–29 the second embodiment of a windup spring using toy according to the present invention.

The windup spring using toy comprises a divisible container C having an imitation tire form, hereinafter referred to as "a tire", as shown in FIGS. 11–16, and a windup spring drive toy D having a toy automobile form, hereinafter referred to as "an automobile", as shown in FIGS. 17–22.

Figure 11:
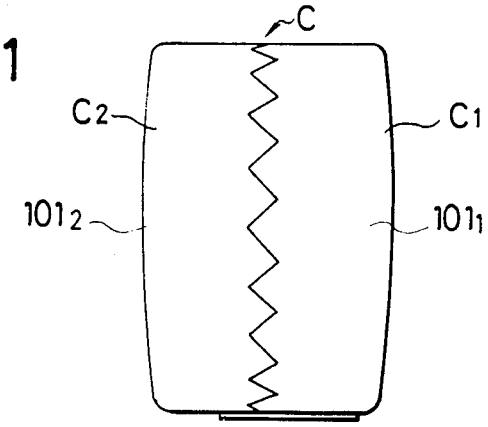
FIG. 11 is a front view of another embodiment of a windup spring using toy according to the present invention.
Figure 12B:
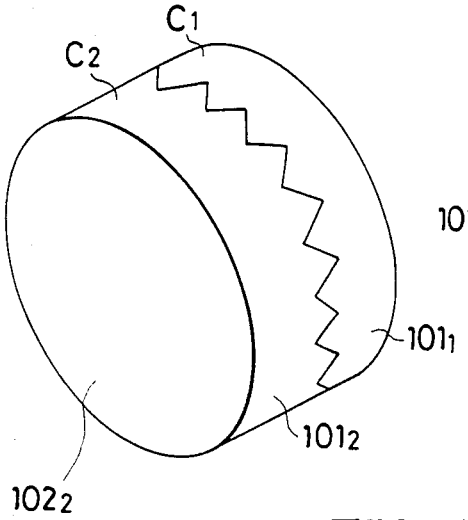
FIGS. 12 A and B are perspective views of FIG. 11, seen from opposite sides.
Figure 12A:
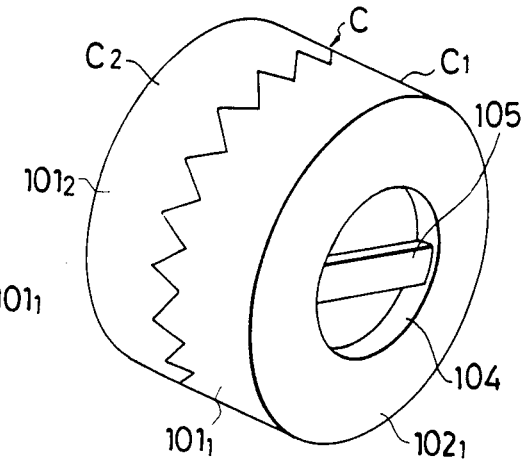
Figure 16:
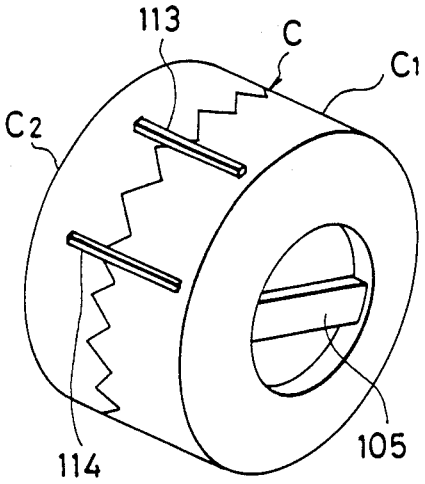
FIG. 16 is another perspective view of FIG. 11, showing its bottom.
Figure 14:
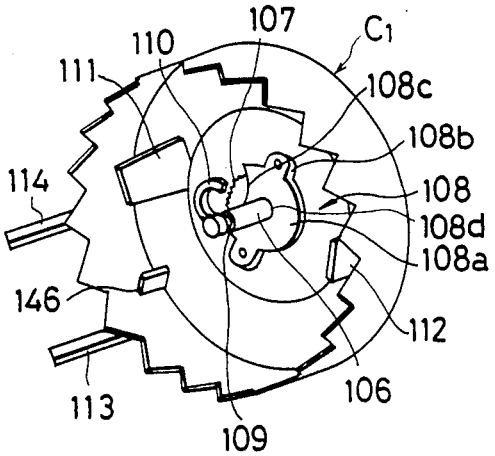
FIG. 14 is a perspective view of one of the divided members of the container having a tire form, as shown in FIG. 11, showing the inside thereof.
Figure 15:
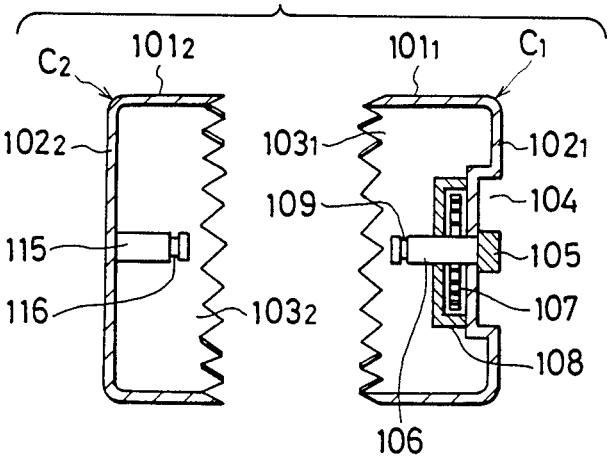
FIG. 15 is an exploded longitudinal cross sectional view of the tire container of FIG. 11.
Figure 17:
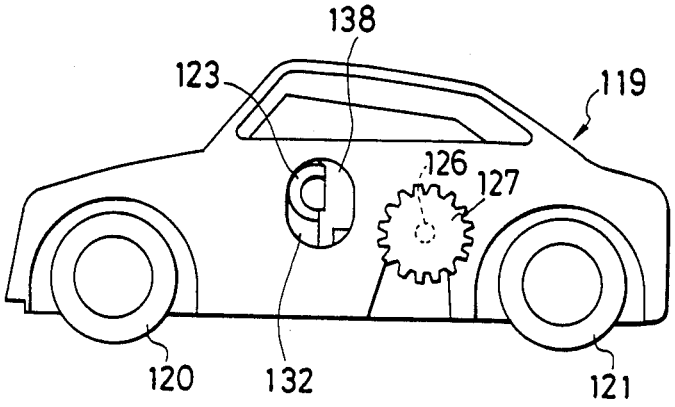
FIG. 17 is a left side view of a windup spring drive toy of an automobile toy to be contained within the tire container of FIG. 11.
Figure 18:
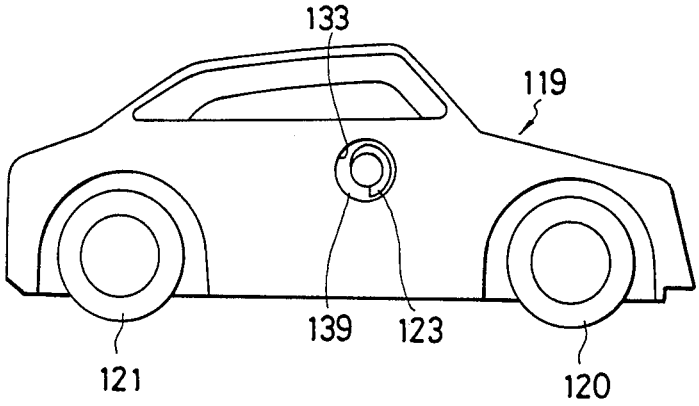
FIG. 18 is a right side view of FIG. 17.

The tire C comprises a pair of divided members $C_1$ and $C_2$, that is, the center of the tread of the tire C is cut into two pieces in a plane perpendicular to its axis by a jagged line to obtain the divided members $C_1$ and $C_2$. Each divided member $C_1$ or $C_2$ includes an annular wall $\mathbf{101}_1$ or $\mathbf{101}_2$, a side wall $\mathbf{102}_1$ or $\mathbf{102}_2$ and a concave space part $\mathbf{103}_1$ or $\mathbf{103}_2$, respectively. The divided members $C_1$ and $C_2$ are connected by placing their jagged open ends opposite each other to form a complete tire form, as shown in FIGS. 11, 12 and 16, in which the automobile may be contained as hereinafter described in detail. One of the jagged open ends of the divided members $C_1$ and $C_2$ is formed in a stepped cross section so that the divided members $C_1$ and $C_2$ may be readily and exactly coupled to each other. The jagged connection line of the divided members $C_1$ and $C_2$ looks like a groove. A plurality of jagged grooves may be formed on the tread of the tire.

The divided member $C_1$ is provided with a circular concave portion 104 in the outer surface of its side wall $\mathbf{102}_1$, in which a windup handle 105 of a − or + shape is arranged. A pivot shaft 106 passes through the side wall $\mathbf{102}_1$ in its center and its one end is fixed to the center of the windup handle 105. A gear wheel 107 is secured onto the pivot shaft 106 close to the inner wall of the side wall $\mathbf{102}_1$ and the pivot shaft 106 projects inside in the concave space part $\mathbf{103}_1$. A bearing member 108 comprises a central cover part 108*a* having approximately a circular form, a pair of mount parts 108*b* projecting radially from opposite sides of the periphery of the cover part 108*a*, a cutout part 108*c* having a circular arc outline, and a central hole 108*d* in the center of the cover part 108*a*. The bearing member 108 is mounted to the inner wall of the side wall $\mathbf{102}_1$ by screws at the mount parts 108*b*, while the pivot shaft 106 is inserted into the central hole $\mathbf{108}_d$ and the cover part 108*a* covers the gear wheel 107 except the cutout part 108*c*. Accordingly, the windup handle 105 is pivotally mounted to the side wall $\mathbf{102}_1$ fixedly while the gear wheel 107 put between the side wall $\mathbf{102}_1$ and the cover part 108*a* of the bearing member 108 is secured to the pivot shaft 106 supported by the bearing member 108.

The pivot shaft 106 is provided with a groove 109 at an outer periphery of its free end portion. The groove 109 may be formed on the pivot shaft 106 close to the bearing member 108.

A guide member 110 having a circular arc form which is coaxial with the cutout part 108c of the bearing member 108, is mounted to the inner wall of the side wall $102_1$ for guiding a gear wheel hereinafter referred to as being engaged with the gear wheel 107. A pair of stoppers 111 and 112 are disposed in the inner side of the side wall $102_1$ for preventing the automobile D contained within the tire C, as hereinafter described, from rotating due to the output energy of its windup spring drive unit. The stoppers 111 and 112 project near the jagged open end of the divided member $C_1$.

Further, the divided member $C_1$ is also provided with a pair of stopping sticks 113 and 114 for preventing the rolling of the tire C on the periphery of the annular wall $101_1$. The stopping sticks 113 and 114 are arranged parallel with each other at a certain distance in a position corresponding to the bottom of the contained automobile D and extend in the same direction as the axis of the pivot shaft 106 beyond the jagged open end of the divided member $C_1$ in contact with the annular wall $101_2$ of the divided member $C_2$, thereby preventing the rolling of the tire C when the tire C is put on the floor.

Instead of only the pair of stopping sticks which are secured onto the annular wall $101_1$ of the divided member $C_1$ and extend to the annular wall $101_2$ of the divided member $C_2$, pairs of stopping sticks may be attached to respective annular walls $101_1$ and $101_2$ of the divided members $C_1$ and $C_2$ along the respective two lines without extending to the other respective divided member. In this case, the stopping sticks may be more strongly secured to the divided members.

The other divided member $C_2$ is provided with a rod 115 projecting inside from the center of its side wall $102_2$ and an annular groove 116 is formed at the outer periphery of the free end portion of the rod 115, similar to the groove 109 of the shaft 106 of the divided member $C_1$.

Figure 19:
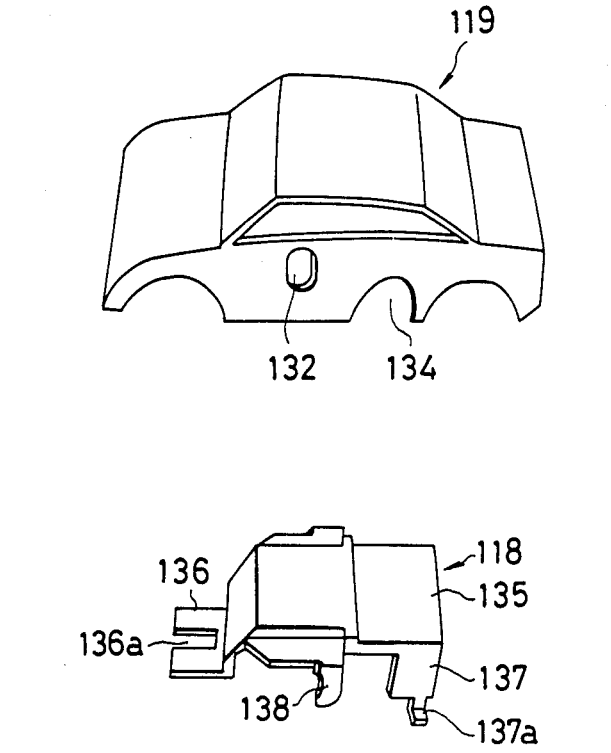
FIG. 19 is an exploded perspective view of FIG. 17.

The automobile D comprises a chassis 117, a slider 118 slidably mounted onto the chassis 117, and a body 119 mounted over the chassis 117, as clearly shown in FIG. 19.

On the chassis 117, a windup spring drive unit 122 having pairs of front and rear wheels 120 and 121 is mounted in a conventional manner. A coupling cylinder 123 is secured to the chassis 117 in its middle portion and extends sideways perpendicular to a central axis of the chassis 117 and a front mount member 124 and a pair of rear mount members 125 for slidably mounting the slider 118 to the chassis 117 are attached to the chassis 117. The windup spring drive unit 122 including a conventional windup spring and a set of gear wheels is provided with an input/output shaft 126 of which opposite ends project to the left and right hand sides of the drive unit 122. On the left end portion of the shaft 126, a gear wheel 127 is secured outside the left side edge of the chassis 117, and on the right end portion of the shaft 126 a disc plate 128 is secured inside the right side edge of the chassis 117. The disc plate 128 is provided with a cam 129 on its outer side. The cam 129 may be secured directly to the shaft 126.

The coupling cylinder 123 opens on its opposite ends to the left and the right hand sides of the automobile D and a biasing member 130 such as a coil spring is fitted in the coupling cylinder 123. The coupling cylinder 123 is mounted to the chassis through a mount member 131.

The front and the rear mount members 124 and 125 for the slider 118 comprise a screw with a head projecting upwards from the front central portion of the chassis 117 and a pair of upset L-shaped pieces mounted on the chassis beside both sides of the drive unit 122, respectively. The front mount member 124 may be an upset L-shaped piece like the rear mount member 125.

After mounting the slider 118 on the chassis 117, the body 119 is mounted thereto. The body 119 is provided with a pair of openings 132 and 133 in its left and right hand sides respectively corresponding to the opposite end openings of the coupling cylinder 123 and a cutout portion 134 for passing the shaft 126 with the gear wheel 127 through its rear left side.

Figure 20:
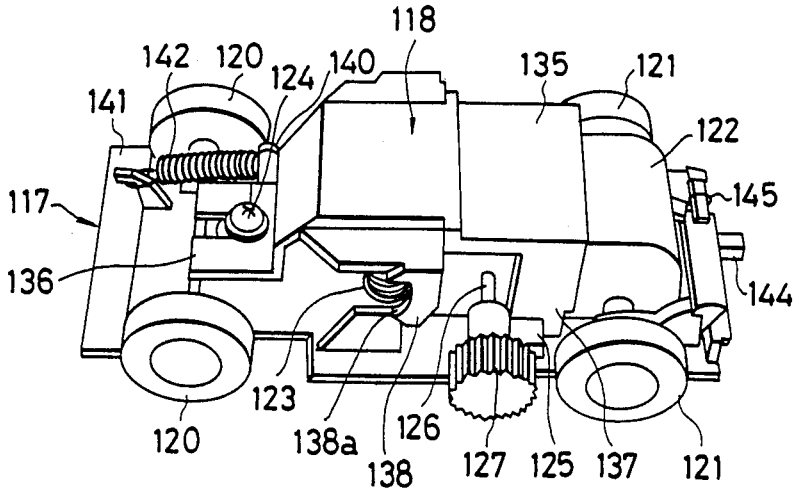
FIG. 20 is a perspective view, seen from the left hand side, of the windup spring drive toy, excluding its body, of FIG. 17.
Figure 21:
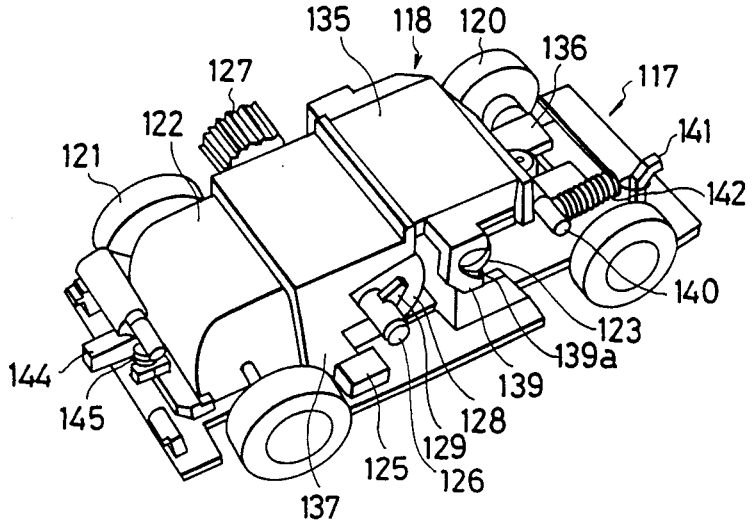
FIG. 21 is a perspective view, seen from the right hand side, of FIG. 20.
Figure 22:
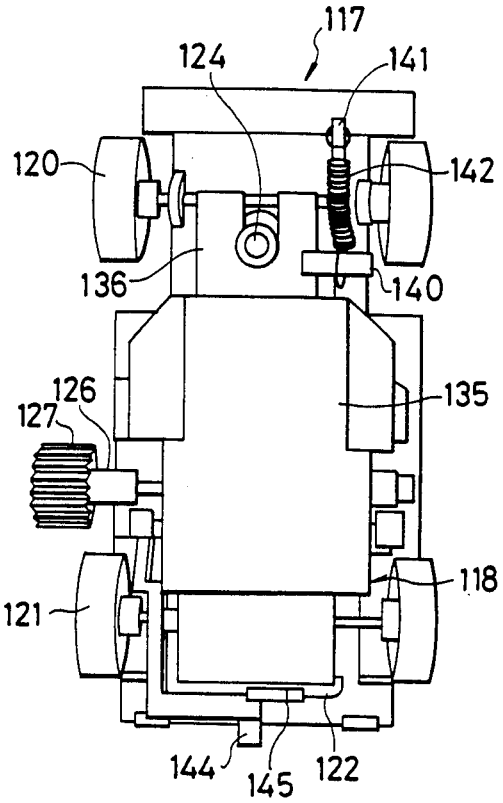
FIG. 22 is a bottom view of FIG. 17.
Figure 23:
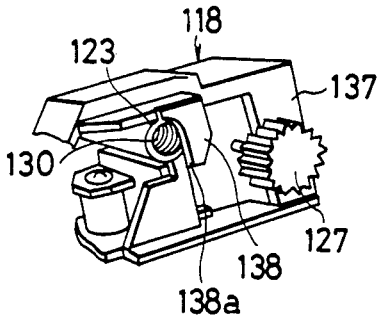
FIG. 23 is a fragmentary perspective view, seen from the left hand side, of the windup spring drive toy of FIG. 17, showing holding means for holding the windup spring drive toy onto the container.
Figure 24:
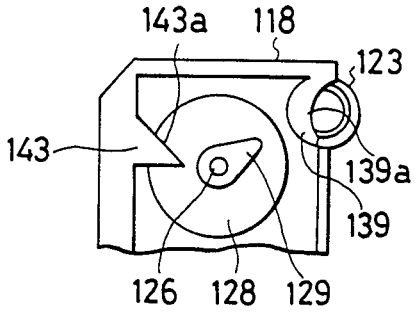
FIG. 24 and 25 are fragmentary right side views of the holding means of FIG. 23 and a slider which explain their functions.
Figure 25:
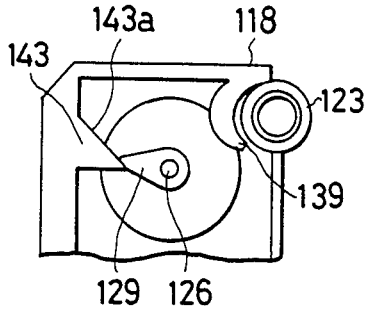

The slider 118 comprises, as shown in FIGS. 19–21, an upper wall part 135 for covering the coupling cylinder 123 and the front half of the drive unit 122, a front part 136 having a L-shaped form connected to the front of the upper wall part 135 and having a cutout groove 136a opening frontwards in its front central portion, a pair of rear side parts 137, each having a L-shaped projection 137a in its lower end, and a pair of engaging members 138 and 139 projecting downwards from the middle of the sides of the upper wall part 135 near the inner surfaces of both sides of the body 119 when it is mounted to the chassis 117.

By slidably fitting the screw 124 and the projections 137a of the rear side parts 137 into the groove 136a of the front part 136 and the guides 125, respectively, the slider 118 is mounted to the chassis 117 slidably backwards and frontwards. The slider 118 is biased frontwards by extending a coil spring 142 between a projection 140 attached to one side of the front part 136 of the slider 118 and another projection 141 mounted to a front upper surface of the chassis 117, resulting in that the dead end of the groove 136a of the front part 136 may butt against the screw 124. Hence, the slider 118 is normally stayed in the fixed position.

Each of the engaging members 138 and 139 is provided with a front arc portion 138a or 139a, of which the outer surface is tapered inwards towards the center of the arc portion. When the slider 118 is positioned in the normal position under biasing by the spring 142, the arc portions 138a and 139a of the engaging members 138 and 139 partially shut the rear portions of the opposite openings of the cylinder 123 as well as the openings 132 and 133 of the body 119, as shown in FIGS. 20, 21, 23 and 24.

The slider 118 is further provided with a triangular piece 143 with a down slant surface 143a in the outer rear side portion of the disc plate 128 and the triangular piece 143 projects in to the rotation plane of the cam 129. When the shaft 126 is rotated in the reverse direction of the windup direction, i.e., counterclockwise in FIGS. 24 and 25, by virtue of the output energy of the windup spring drive unit 122, the rotating cam 129 pushes the slant surface 143a of the triangular piece 143 and thus the slider 118 rearwards, i.e., in the left hand side direction in FIGS. 24 and 25, thereby separating the engaging members 138 and 139 from the openings of the cylinder 123 to fully release the openings of the cylinder 123.

Next, the operation of the above described windup spring using toy comprising the tire C and the automobile D will be described in detail as follows.

First, the left side of the automobile D is contained within the concave space $103_1$ of the divided member $C_1$ having the windup handle 105 and the stoppers 111 and 112 by engaging the gear wheel 127 guided by the guide member 110 with the gear wheel 107 in the cutout portion 108c of the bearing member 108 and inserting the free end of the pivot shaft 106 of the divided member $C_1$ into the left opening of the cylinder 123 of the automobile D via the left opening 132 of the body 119 and the arc portion 138*a* of the engaging member 138 of the slider 118 against the biasing forces of the springs 130 and 142 until the groove 109 of the pivot shaft 106 is engaged with the arc portion 138*a* of the engaging member 138, while the rear window and the hood of the automobile D are contacted with the stoppers 111 and 112, respectively. On this occasion, the coil spring 130 fitted in the cylinder 123 biases the pivot shaft 106 outwards.

Then, the right side of the automobile D is contained within the concave space $103_2$ of the divided member $C_2$ by inserting the free end of the rod 115 of the divided member $C_2$ into the right opening of the cylinder 123 of the automobile D via the right opening 133 of the body 119 and the arc portion 139*a* of the engaging member 139 of the slider 118 against the biasing force of the spring 130 within the cylinder 123 until the groove 116 of the rod 115 is engaged with the arc portion 139*a* of the engaging member 139, while the jagged open end of the annular wall $101_2$ of the divided member $C_2$ is coupled to the jagged open end of the annular wall $101_1$ of the divided member $C_1$. On this occasion, the coil spring 130 in the cylinder 123 also biases the rod 115 outwards.

Hence, the automobile D is entirely hidden within the completed form of the tire C, and simultaneously the automobile D is held onto the tire C therein. In this case, since the tire C is provided with the pair of stopping sticks on its periphery, the tire C may stay in its predetermined position on the floor.

Figure 13:
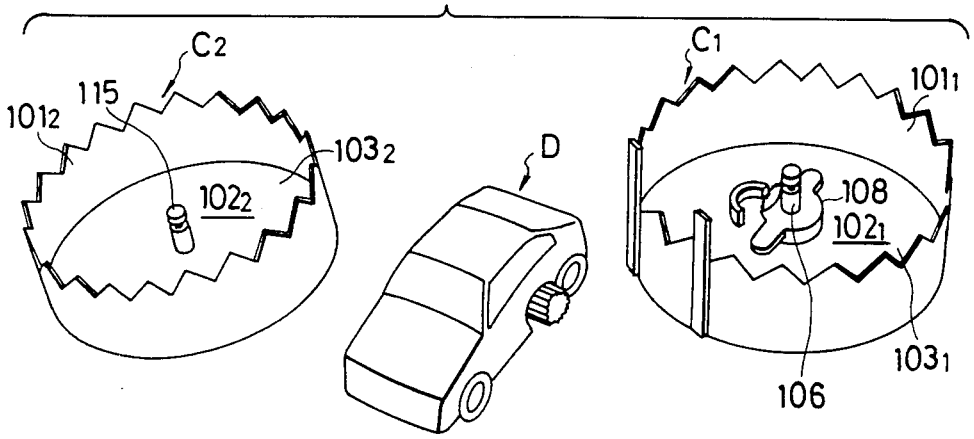
FIG. 13 is an exploded perspective view of FIG. 11.

Next, while the coupled tire C is held by hand, the windup spring of the windup spring drive unit 122 is wound up by rotating the windup handle 105 through the pivot shaft 106, the gear wheel 107 of the divided member $C_1$ and the gear wheel 127 and the input shaft 126 of the automobile D, to store the energy in the drive unit 122. During the windup operation of the windup spring, the cam 129 idles with respect to the shaft 126 in the same manner as the first embodiment or in a conventional manner. After sufficiently winding up the windup spring of the drive unit 122, when the tire C containing the automobile D therein is put on the floor and released from the hands of the operator, the stored energy of the windup spring drive unit 122 is released to rotate the shaft 126 in the reverse direction to that of its windup along with the rotation of the cam 129 in the counterclockwise direction in FIGS. 24 and 25. Accordingly, the cam 129 pushes the triangular piece 143 and thus the slider 118 rearwards, thereby disengaging the arc portions 138*a* and 139*a* of the engaging members 138 and 139 of the automobile D from the grooves 109 and 116 of the respective shaft 106 and rod 115 of the respective divided members $C_1$ and $C_2$ against the biasing force of the spring 142 which biases the slider 118 frontwards. Consequently, the pivot shaft 106 and the rod 115 of the divided members $C_1$ and $C_2$ are pushed outwards separate from the openings 132 and 133 of the body 119 of the automobile D by the biasing force of the coil spring 130 in the cylinder 123, and thereby the divided members $C_1$ and $C_2$ are vigorously divided into two, with the result that the automobile D suddenly emerges from the divided members $C_1$ and $C_2$ and falls down therefrom onto the floor, as shown in FIG. 13.

In this embodiment, since the rear wheels 121 of the automobile D are rotated by the drive unit 122 soon after the hands are separated from the tire C after finishing the windup operation of the drive unit 122, the complete tire C is suddenly divided into two after a few seconds and the automobile D appears from the inside of the divided tire C and starts to run on the floor as soon as the automobile D falls down on the floor, which is, given the sudden emergence of the automobile D from the divided tire C, interesting, extraordinary and unexpected.

In a conventional windup spring drive unit, since the drive unit is directly connected to an input shaft on which rear wheels are mounted, when the windup spring is released, the rear wheels are rotated very quickly. Accordingly, if a conventional windup spring unit drive is designed so that if, after the hands are separated from the tire C a relatively large amount of time elapses before the tire is divided in two, the rear wheels are idled at a high speed until the automobile appears after the tire is divided into two, and thus there is little remaining energy in the windup spring, with the result that the automobile can not run a long distance.

In this embodiment, the windup spring drive unit 122 further includes a speed reduction shaft 158, a speed change lever 144 projecting rearwards from the rear end of the chassis 117, and a spring 145 for biasing the speed change lever 144 to its high speed side. Further, the divided member $C_1$ is formed with a stopper 146 which holds the speed change lever 144 to its low speed side against the spring 145 when the automobile D is contained within the divided member $C_1$.

In FIGS. 26–29, an improved windup spring drive unit 122 is shown. In the front part of a case 147 is mounted the input shaft 126 across the case sideways, on which an inside end of a windup spring 148 whose outside end is mounted to the case 147, and a pair of large and small gear wheels 149 and 150 are secured. With the small gear wheel 150 are consecutively engaged first and second intermediate gear wheels 151 and 152, and with the second gear wheel 152 is engaged a small gear wheel 154 secured to a rear wheel shaft 153.

In the upper part of the second intermediate gear wheel 152, a first idle gear wheel 155 comprising a pair of large and small gear wheels 155*a* and 155*b* is rotatably mounted to the case 147 via a shaft 155*c* which is inserted in a slant slot 156 formed in the case so that the first idle gear wheel 155 may be movable up and down. A speed reduction shaft 158 having a small gear 157 thereon is rotatably mounted to the case 147. When the first idle gear wheel 155 is lowered, the large gear wheel 155*a* engages with the small gear 157, and the small gear wheel 155*b* engages with the first intermediate gear wheel 151.

In the relatively upper part of the input shaft 126, a second idle gear wheel 159 comprising a pair of small and large gear wheels 159*a* and 159*b* is rotatably mounted to the case 147 via a shaft which is inserted in another slant slot so that the second idle gear wheel 159 may be movable up and down. When the second idle gear wheel 159 is moved in the lower position of the slot 156, the small gear wheel 159*a* engaged with the large gear wheel 149 secured to the input shaft 126, and the large gear wheel 159*b* engages with a small gear 152*a* secured coaxially with the second intermediate gear wheel 152. When the second idle gear wheel 159 is moved in the upper position of the slot, the large gear wheel 159*b* disengages from the small gear wheel 152*a*. The first and the second idle gear wheels 155 and 159 are moved in their upper positions by the second intermediate gear wheel 152 and the large gear wheel 149 on the input shaft 126, respectively.

Another gear wheel 160 is mounted to the speed reduction shaft 158, and a speed reduction gear wheel 161 is pivotally mounted to the case 147 to engage with the gear wheel 160. When a rotating force is given to the speed reduction shaft 158 via the first idle gear wheel 155, the speed reduction gear wheel 161 is pivoted to move the teeth of the gear wheel 160 one by one, thereby lowering the rotation speed of the speed reduction shaft 158.

Further, in the rear portion of the case 147 of the drive unit 122, the speed change lever 144 is pivotally mounted around a horizontal shaft 164. The lever 144 includes a connection part 162 having an arc cross section and bifurcated actuating projections 163 projecting frontwards in an upset V-shaped cross section from the connection part 162. When the lever 144 is pivoted downwards, as shown in FIG. 29*a*, the projections 163 of the lever 144 raise the shaft 155*c* of the first idle gear wheel 155 in the upper position of the slot 156, and the upward movements of the projections 163 are restricted by stopper pins 165 and 166 secured to the case 147. When the lever 144 is pivoted upwards, as shown in FIG. 29*b*, the projections 163 are separated from the shaft 155*c* of the first idle gear wheel 155, and the first idle gear wheel 155 moves downwards in the lower position of the slot 156 due to its own weight, thereby engaging the first idle gear wheel 155 with the gear wheel 157 of the speed reduction shaft 158. The lever 144 is biased downwards by the spring 145 extended between the lever 144 and the chassis 117.

When the automobile D is contained within the tire C, the speed change lever 144 is kept to be pivoted upwards by the stopper 146 of the divided member $C_1$, as shown in FIG. 29*b*, and hence, the large gear wheel 149 is connected to the gear wheel 157 of the speed reduction shaft 158 through the second idle gear wheel 159, the second intermediate gear wheel 152, and the first idle gear wheel 155. Therefore, when the stored energy of the drive unit 122 is released to rotate the shaft 126, the rotation speed of the speed reduction shaft 158 is lowered by the speed reduction gear wheel 161, and the rotation speed of the gear wheel 154 secured on the rear wheel shaft 153, which is engaged with the second intermediate gear wheel 152, is also reduced. Consequently, when the automobile D is contained in the tire C, the rear wheels 121 are rotated at a low speed to prevent the rapid spending of the output energy of the drive unit 122.

On the other hand, as soon as the automobile D appears upon the dividing of the tire C into two, the speed change lever 144 is pivoted downwards by the spring 145, and the first idle gear wheel 155 is moved in the upper position of the slot 156 by the projections 163 of the lever 144. Hence, the first idle gear wheel 155 is disengaged from the second intermediate gear wheel 152 and the gear wheel 157 mounted on the speed reduction shaft 158, as shown in FIG. 29*a*. Then, the driving force of the drive unit 122 is transferred from the large gear wheel 149 to the gear wheel 154 on the rear wheel shaft 153 through the second idle gear wheel 159 and the second intermediate gear wheel 152. Consequently, since the driving force of the drive unit 122 is not transferred to the speed reduction shaft 158, the rear wheels 121 are rotated at a high speed, and thus the automobile D starts to run at a high speed soon after falling down on the floor.

In this case, since the gear wheel 154 on the rear wheel shaft 153 is always engaged with the small gear wheel 150 on the input shaft 126 through the second and the first intermediate gear wheels 152 and 151, the windup spring of the drive unit 122 of the automobile D may be wound up by pulling it back in contact with the floor in a conventional manner. Then, the automobile D is let go of on the floor, and the automobile D runs at a high speed on the floor. By a series of input gear wheels 154, 152, 151 and 150 and a series of output gear wheels 149, 159*a*, 159*b*, 152*a*, 152 and 154, whose gear ratios are different from each other, the drive unit 122 can be stored with a large amount of energy therein by a small pullback of the automobile D. Then the automobile D may run at a high speed on the floor in the conventional manner.

According to the present invention the openings 132 and 133 of the body 119 may be unnecessary depending on its shape.

According to the present invention the windup spring using toy comprises a divisible container having a single form in its undivided state and including a windup means, and a windup spring drive toy to be contained within the container having a windup spring drive unit therein, which is wound up by the windup means of the container when the windup spring drive toy is contained within the container. The windup spring using toy further includes means for holding the windup spring drive toy onto the container when the windup spring drive toy is contained within the container, and means for releasing the holding of the windup spring drive toy in the container by the output energy of the windup spring drive unit. The container is divided into two in a moment or after a certain time by virtue of the stored energy of the windup spring when the windup spring using toy is put on a floor or table after winding up the windup spring of the windup spring drive unit. The windup spring drive toy contained within the container then suddenly appears and starts to run by means of the windup spring drive unit. The overall effect of this toy is both extraordinary and unexpected.

It is readily understood that by pushing together from both sides the divided members of a container, such as an eggshell or an imitation tire, onto a windup spring drive toy such as a child dinosaur and a toy automobile, the divided members are fitted on the windup spring drive toy to form a complete container form and, at the same time, the holding means holds the windup spring drive toy onto the container.

In the windup spring using toy according to the present invention, the windup spring of the windup spring drive unit of the windup spring drive toy may be readily wound up from the outside by hand to store the energy in the windup spring drive unit.

According to the present invention, after storing the energy in the windup spring drive unit of the windup spring drive toy, the windup spring using toy is put on a floor, and then, upon the separation of the hand therefrom, the windup spring using toy is divided into two by the output energy of the windup spring drive unit due to the biasing force of a biasing means such as a coil spring and coil springs, with the result that the windup spring drive toy suddenly appears and starts to run on the floor by means of the windup spring drive unit.

Although the present invention has been described in its preferred embodiments with reference to the accompanying drawings, it is readily understood that various changes and modifications may be made by those skilled in the art without departing from the spirit and scope of the present invention.

For instance, the container may be a garage and the windup spring drive toy may be a motorcycle. The motorcycle suddenly appears and starts to run as soon as the garage is divided into two pieces.

What is claimed is:

1. A windup spring using toy comprising, in combination:

a divisible container having a single form in its undivided state and including a windup means; and a windup spring drive toy to be contained within the container, having a windup spring drive unit therein, which is wound up by the windup means of the container when the windup spring drive toy is contained within the container, the windup spring using toy further including, means for holding the windup spring drive toy onto the container when the windup spring drive toy is contained within the container; and means for releasing the holding of the windup spring drive toy in the container by the output energy of the windup spring drive unit.

2. A toy as defined in claim 1, wherein the container comprises a pair of divided members, of which the open ends thereof are placed opposite each other to obtain the complete form of the container, and the windup means is rotatably mounted to one divided member.

3. A toy as defined in claim 2, wherein the windup means is provided with a rotary shaft projecting from inside of a first divided member, and the second divided member is provided with a projection extending from the inside thereof corresponding to the rotary shaft of the first divided member, wherein the holding means comprises a pair of engaging members provided on the free end portion of the rotary shaft and the projection of the first divided member and the second divided member respectively, and a pair of engaging parts provided on both sides of the windup spring drive toy, the first pair of engaging members being engageable with the second pair of engaging parts, while the rotary shaft and the projection are biased outwards when the windup spring drive toy is contained within the container, wherein the windup means includes a first gear wheel secured on the rotary shaft, and the windup spring drive unit having an input shaft includes a second gear wheel secured thereon, which is engageable with the first gear wheel when the engaging members of the divided members are engaged with the engaging parts of the windup spring drive toy, and wherein the releasing means comprises a cam member mounted on the input shaft of the windup spring drive unit for releasing the engagements between the engaging members of the divided members and the engaging parts of the windup spring drive toy when the stored energy of the windup spring drive unit is output.

4. A toy as defined in claim 1, wherein the container has an eggshell form and the windup spring drive toy has a child dinosaur form.

5. A toy as defined in claim 1, wherein the container has an imitation tire form and the windup spring drive toy has a toy automobile form.

6. A toy as defined claim 2, wherein the container has an eggshell form and the windup spring drive toy has a child dinosaur form.

7. A toy as defined in claim 3, wherein the container has an eggshell form and the windup spring drive toy has a child dinosaur form.

8. A toy as defined in claim 2, wherein the container has an imitation tire form and the windup spring drive toy has a toy automobile form.

9. A toy as defined in claim 3, wherein the container has an imitation tire form and the windup spring drive toy has a toy automobile form.

10. A combination toy comprising:

a divisible hollow housing container having a single form in its undivided state;

a separable self-powered mobile toy member operatively contained and mounted within the housing container in its undivided state;

means for storing power in the mobile toy member from the exterior of the container; and, means for positioning and forceably dividing the divisible housing container at a predetermined time for releasing the mobile toy member in an operative positive for self-propulsion.

11. A toy as defined in claim 6, wherein means are provided with the divisible container to assume a position prior to the timed release so that the separable mobile toy member therein is upright.

12. A toy as defined in claim 7, wherein the shape of the divisible container is approximately spherical and the combined weight of the divisible container and the separable mobile toy therein is distributed such that the divisible container can rotate to a position in which the separable mobile toy is upright.

13. A combination toy comprising:

a divisible egg-shaped housing container;

a separable mobile windup spring powered toy having a dinosaur form operatively contained within the egg-shaped housing container;

alignment means attached to the egg-shaped housing container for permitting the egg-shaped housing container containing the dinosaur toy to rotate to a position in which the dinosaur toy is upright;

an externally located winder to provide power to the spring powered dinosaur toy so that it can be wound up while contained within the egg-shaped housing container; and, a spring release mechanism which forceably divides the divisible egg-shaped container at a predetermined time for releasing the mobile windup spring powered dinosaur toy for self-propulsion.

14. A combination toy comprising:

a divisible tire-shaped housing container;

a separable windup spring powered automobile operatively contained within the tire-shaped housing container;

a pair of positioning members affixed to the periphery of the tire-shaped housing container to establish a position of the housing container such that the automobile is upright therein;

an externally mounted winder disposed in the center of the tire-shaped housing container with which the windup spring powered automobile can be wound up while contained within the tire-shaped container; and a spring release mechanism which forceably divides the tire-shaped housing container at a predetermined time for releasing the spring powered automobile for self-propulsion.

* * * * *